United States Patent [19]

Mowbray

[11] 3,936,232

[45] Feb. 3, 1976

[54] FUEL INJECTION PUMPING APPARATUS WITH TIMING ADJUSTMENT

[75] Inventor: Dorian Farrar Mowbray, Burnham, England

[73] Assignee: C.A.V. Limited, Birmingham, England

[22] Filed: Apr. 9, 1974

[21] Appl. No.: 459,342

[30] Foreign Application Priority Data

Apr. 14, 1973 United Kingdom ..... 18096/73

[52] U.S. Cl. ..... 417/206; 417/252; 417/253; 417/462; 123/139 AQ

[51] Int. Cl.[2].. F04B 23/12; F04B 19/02; F04B 3/00

[58] Field of Search ..... 417/202, 218, 219, 221, 417/252, 253, 462, 206; 123/139 AE, 139 AR, 139 AQ

[56] References Cited

UNITED STATES PATENTS

| | | | |
|---|---|---|---|
| 3,439,624 | 4/1969 | Glikin et al. | 417/206 |
| 3,536,421 | 10/1970 | Kemp | 417/253 |

FOREIGN PATENTS OR APPLICATIONS

| | | | |
|---|---|---|---|
| 1,092,727 | 11/1960 | Germany | 407/206 |
| 978,116 | 12/1964 | United Kingdom | 417/252 |

*Primary Examiner*—John J. Vrablik
*Attorney, Agent, or Firm*—Holman & Stern

[57] ABSTRACT

The invention relates to a fuel injection pumping apparatus which includes a feed pump the output pressure of which is controlled by valve. The feed pump supplies fuel to an injection pump under the control of a shuttle which is movable in a bore. The extent of movement of the shuttle determines the amount of fuel supplied by the injection pump to the associated engine. In addition, a fluid pressure operable device is provided to control the timing of injection of fuel to the engine, and the pressure for controlling the device is obtained from a point intermediate a fixed restrictor and a variable restrictor constituted by a groove formed in the shuttle and a port formed in wall of the bore accommodating the shuttle. Fuel from the outlet of the pump flows through the fixed and variable restrictors.

4 Claims, 2 Drawing Figures

FUEL INJECTION PUMPING APPARATUS WITH TIMING ADJUSTMENT

This invention relates to liquid fuel injection pumping apparatus of the kind comprising an injection pump adapted to be driven in timed relationship with an engine to which fuel is to be supplied, a shuttle slidable within a bore, and means for conveying fuel from one end of the bore to the injection pump during a filling stroke of the injection pump, the excursion of said shuttle being indicative of the amount of fuel supplied to the engine and fluid pressure operable means for effecting an adjustment to the timing of injection of fuel to the engine.

The object of the invention is to provide such an apparatus in a simple and convenient form.

According to the invention, in an apparatus of the kind specified, said shuttle is provided with a groove and the wall of the bore with co-operating ports, said ports and groove forming part of a fluid pressure control circuit to said fluid pressure operable means whereby the fluid pressure applied to said means varies in accordance with the amount of fuel supplied to the engine.

Figure 1:
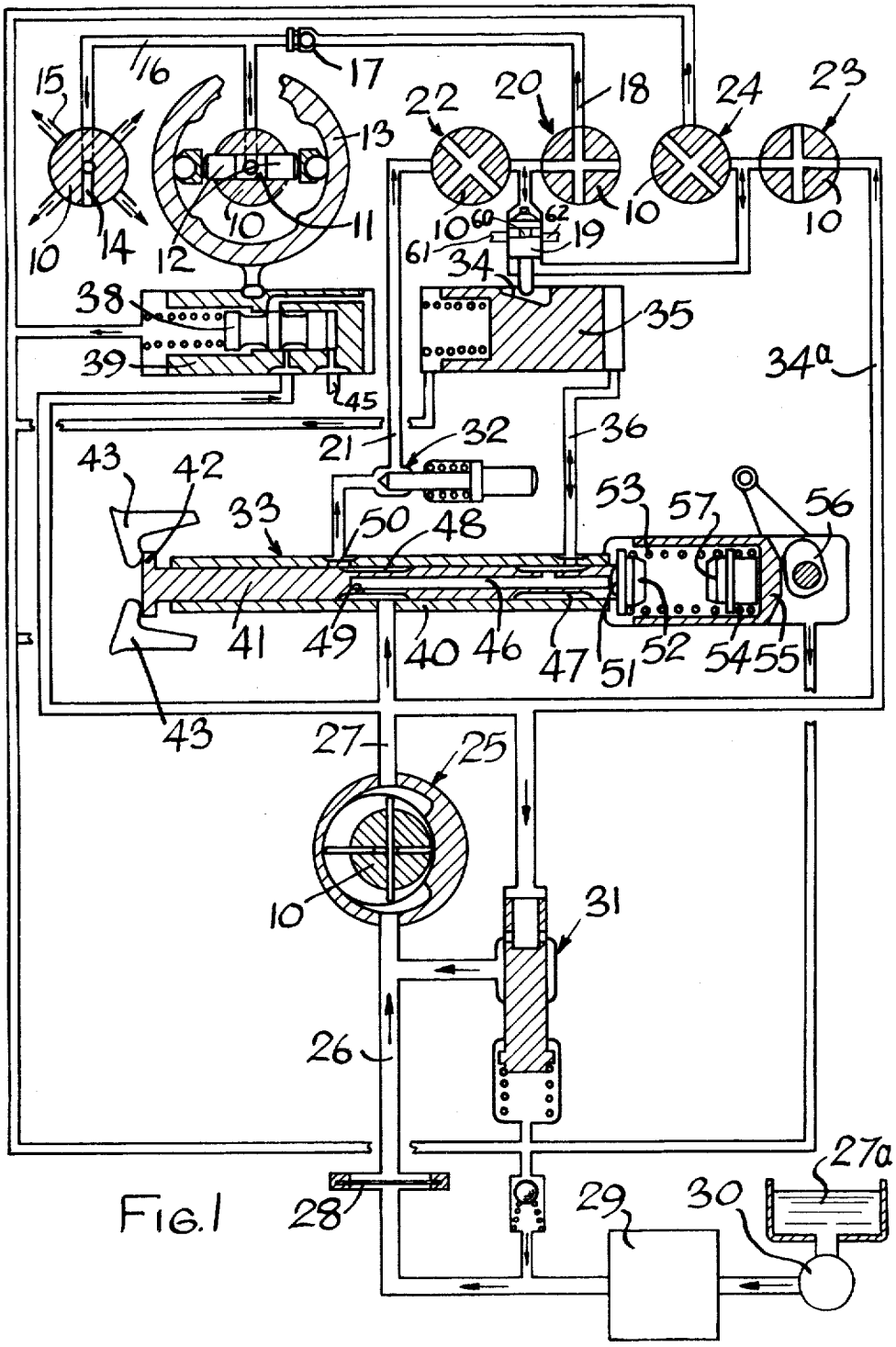
Figure 2:
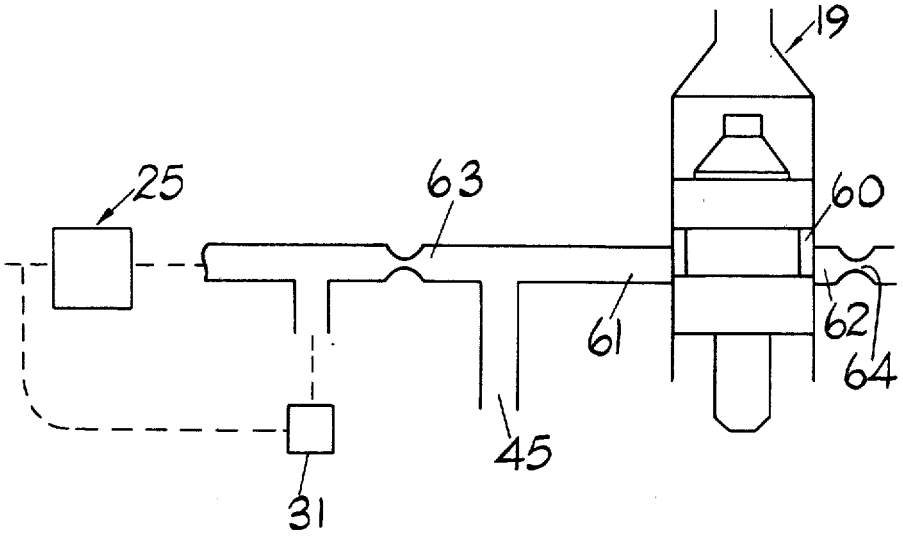

One example of a liquid fuel pumping apparatus in accordance with the invention will now be described with reference to the accompanying drawings, in which:

FIG. 1 is a diagrammatic representation of the basic form of apparatus to which the invention may be applied, and FIG. 2 is an illustration of the modifications necessary to the apparatus shown in FIG. 1.

Referring to FIG. 1 of the drawings, the apparatus comprises a body part in which is journalled a rotary cylindrical distributor member 10 which is shown divided into seven parts. The distributor member is adapted to be driven in timed relationship with the engine with which the apparatus is associated and at one point in the distributor member there is formed a transversely extending bore 11, in which is mounted a pair of reciprocable pumping plungers 12. Surrounding the distributor member at this point is an annular cam ring 13 having on its internal periphery, a plurality of pairs of diametrically disposed cam lobes. The cam lobes, through the intermediary of rollers respectively, act upon rotation of the distributor member, to move the pumping plungers 12 inwardly thereby to expel fuel contained within the transverse bore 11.

The transverse bore 11 communicates with a passage 16 extending within the distributor member, and at one point this passage communicates with an outwardly extending delivery passage 14 which is adapted to register in turn, and as the distributor member rotates, with a plurality of outlet ports 15 formed in the body part. The outlet ports in use, are connected to the injection nozzles respectively of the associated engine.

The passage 16 is in communication by way of a check valve 17, with a passage 18 and this passage can be brought into communication with one end of a bore containing a slidable shuttle 19, by means of a rotary valve 20. The aforesaid one end of the bore at other times, as will be explained, can be placed in communication with a feed passage 21 by means of a rotary valve 22.

The other end of the bore containing the shuttle, can be placed in communication with a source of fuel at high pressure by means of a rotary valve 23 or with a source of fuel at low pressure by means of a rotary valve 24. The valves 20, 22, 23 and 24 are formed in or on the distributor member 10 and are driven in timed relationship with the engine. In addition, also mounted on the distributor member is a feed pump 25 of the rotary vane type and having an inlet 26 and an outlet 27. The inlet 26 is in communication with a supply of fuel **27*a* by way of a pair of filter units 28 and 29. A lift pump 30 is provided to ensure the supply of fuel to the feed pump. The outlet pressure of the feed pump 25 is controlled by a relief valve 31** which spills fuel between the inlet and outlet of the pump.

The relief valve 31 includes a member which is moved by means of a spring in a direction to prevent flow of fuel between the inlet and the outlet of the pump 25 and as the outlet pressure of the pump increases, the member moves to permit flow of fuel thereby to control the output pressure of the feed pump.

The outlet 27 of the feed pump 25 is in communication with the feed passage 21 by way of a normally open valve 32 and a metering valve 33 which will be described in greater detail. In addition, the outlet 27 of the feed pump, can be placed in communication with the aforesaid other end of the bore containing the shuttle 19, by way of a passage **34*a* and a rotary valve 23**.

The operation of the apparatus thus far described is as follows. With the parts of the apparatus in the position shown in FIG. 1, fuel is flowing from the outlet of the feed pump by way of the valve 23 to said other end of the bore, and the shuttle 19 is being moved towards said one end of the bore. Fuel is therefore displaced from this end of the cylinder and flows by way of the rotary valve 20, and the check valve 17, to the passage 16 and particularly to the bore 11. The plungers 12 are therefore moved outwardly by an amount dependent upon the quantity of fuel displaced by the shuttle 19.

During continued rotation of the distributor member, the passage 14 is brought into register with an outlet port 15, and during this time, the plungers 12 are moved inwardly and fuel is displaced from the bore 11 to the appropriate engine cylinder. Also during this time, the rotary valves 20 and 23 are closed, and valves 22 and 24 are open so that fuel now flows to said one end of the bore containing the shuttle 19 and the shuttle is therefore moved towards the other end of the bore. The quantity of fuel which is supplied to the bore is controlled by the metering valve 33 which thus determines the quantity of fuel which is supplied to the injection pump during a filling stroke, and thereby the amount of fuel which is supplied to the associated engine at each injection stroke. During continued rotation of the distributor member, the process described is repeated and fuel supplied to the engine cylinders in turn.

It will be appreciated that the shuttle 19 determines the maximum quantity of fuel which can be supplied by the apparatus at each injection stroke. The maximum quantity of fuel which is supplied to an engine, is varied in accordance with the speed of the engine to provide shaping of the maximum fuel characteristic so that the maximum excursion of the shuttle must be made to vary in accordance with the speed of the engine. For this purpose, the shuttle 19 is provided with an extended end portion which can co-operate with a cam surface 34 formed on a spring loaded piston 35. The piston is movable against the action of its spring by means of fuel supplied under pressure to one end of the cylinder by way of a passage 36. The pressure of the fuel is dependent upon the speed at which the apparatus is driven, and the way in which it is derived will be explained. The result is that the axial setting of the piston will be dependent upon the speed of the associated engine, and consequently the allowed excursion of the shuttle will also be dependent upon the engine speed.

There is provided a fluid pressure operable member in the form of a servo piston 39 which is connected to the cam ring 13 by means of a peg. The piston 39 is provided with a bore in which is mounted a spring loaded servo valve 38. The servo valve controls the admission or escape of fuel under pressure from one end of the cylinder containing the piston 39. The fuel under pressure is derived from the outlet 27 of the feed pump 25, and the servo valve 38 is subjected to a pressure existing in a conduit means 45. As this pressure increases, the servo valve 38 will be moved against the action of its spring towards the left as seen in FIG. 1 and the servo piston 37 will follow this movement thereby moving the cam ring 13 angularly and altering the timing of injection of fuel to the engine.

Considering now the metering valve 33. This comprises a sleeve 40 which is fixed within the body of the apparatus. Within the sleeve there is mounted an axially slidable rod member 41 which at one end is provided with a head 42 against which bear the two portions of, as illustrated, a pair of governor weights 43. The weights are mounted within a cage (not shown) and the latter is driven by gearing from the distributor member 10 so that the speed of rotation of the weights is directly proportional to the speed at which the engine is driven. Extending axially within the rod member, is a blind bore 46 which is open to the end of the rod member remote from the weights. The bore 46 is in full communication with a circumferential groove 47 formed on the periphery of the rod member, and this groove is in open communication with the passage 46. The bore 46 is in restricted communication with a further circumferential groove 48 by way of an orifice 49. The groove 48 is in open communication with the outlet 27 of the feed pump, and is in variable communication with a port 50 formed in the sleeve 40. The port 50 communicates with the feed passage 21.

The bore 46 at its open end constitutes a spill port 51 which can be closed by a valve element 52, urged to close the port by a pair of governor springs 53, 54. These springs are partly housed within a hollow and slidable abutment 55, the position of which is controlled by an operator adjustable cam 56. Intermediate the two springs is a stop member 57 which acts to limit the deflection of the relatively light spring 54.

In use, the axial position of the rod member 41 and therefore the degree of registration of the groove 48 with the port 50, is determined by the force acting on one end of the rod due to the weights, and the opposing force exerted by the spring or springs. For a steady speed, these forces are balanced, but should the speed vary then the rod will move axially to increase or decrease the registration of the groove 48 and port 50 so as to increase or decrease the quantity of fuel supplied to the engine. In this manner the weights and springs together with the rod member, the groove 48 and the port 50 act as a mechanical governor. By altering the force exerted by the spring or springs, the operator can control the speed at which the engine operates.

The fuel under pressure within the bore 46, acts intermediate the rod member 41 and valve element 52 to effect separation thereof. The force developed is opposed by the force transmitted through the rod member, i.e. the force exerted by the weights or the governor springs. As the valve element is moved away from the rod member, fuel is spilled from the bore 46 and due to the orifice 49, the pressure therein falls until an equilibrium position is reached. With variation in speed, the pressure rises or falls depending on the change of speed, and due to the fact that the force developed by the weights depends upon the square of the speed so the fuel pressure within the bore 46 varies as the square of the speed. The light spring 54 during normal operation is fully compressed, and operates as the governor spring when the engine is idling.

Referring now to FIG. 2 for an explanation of how the pressure within the conduit means 45 is developed. As illustrated in FIG. 2, the shuttle 19 is provided with a circumferential groove 60 and formed in the wall of the bore are registering ports 61, 62. Port 61 is in communication with the outlet 27 of the feed pump 25 by way of a restricted orifice 63 and the conduit means 45 leads from a point intermediate the port 61 and the restricted orifice 63. Port 62 communicates with a low pressure conveniently the inlet of the pump 25, by way of a further restricted orifice 64.

In operation, the pressure of fuel within the conduit means 45 depends on the excursion of the shuttle 19 within its bore, and if for instance the excursion of the shuttle is small, then the degree of registration of the ports 61 and 62 with the circumferential groove 60 will be less than that which will obtain when the excursion of the shuttle increases. As a result the pressure within the conduit means 45 will be high when the quantity of fuel being supplied is low and will decrease as the quantity of fuel supplied increases. The magnitude of the fluid pressure in the conduit means, is dependent therefore upon the speed because the outlet pressure of the pump 25 increases with speed and also upon the excursion of the shuttle. The latter determines the amount of fuel supplied to the engine, and therefore represents the load on the engine. The orifice 64 is provided to minimise the amount of fuel which is lost from the total quantity of fuel delivered by the feed pump 25.

I claim:

1. A liquid fuel injection pumping apparatus comprising an injection pump adapted to be driven in timed relationship with an engine to which fuel is to be supplied, a shuttle slidable within a bore, means for conveying fuel displaced by movement of the shuttle from one end of the bore to the injection pump during a filling stroke of the injection pump, the excursion of the shuttle being indicative of the amount of fuel supplied to the engine, fluid pressure operable means operatively associated with the injection pump for effecting an adjustment to the timing of injection of fuel to the engine, a fluid pressure control circuit for controlling the fluid pressure applied to said fluid pressure operable means, said control circuit comprising a groove formed on the shuttle, a pair of ports formed in the wall of the bore, said ports being placed in variable communication with each other by the groove to control a flow of liquid between said ports and thereby the pressure applied to said fluid pressure operable means, whereby the fluid pressure applied to said fluid pressure operable means varies in accordance with the amount of fuel supplied to the engine.

2. An apparatus as claimed in claim 1 including a fluid pump and in which the fluid pressure control circuit comprises a conduit extending from the outlet of said fluid pump, a restrictor in said conduit, said conduit communicating with one of said ports, the extent of registration of the ports with the groove determining the flow of fluid through the conduit and the pressure intermediate said restrictor and said one port varying in accordance with the degree of registration, said pressure being applied to said fluid pressure operable means.

3. An apparatus as claimed in claim 2 including a further conduit extending between the other port and a drain, said further conduit incorporating a further restrictor.

4. An apparatus as claimed in claim 2 in which said fluid pump comprises a fuel feed pump which supplies fuel to the injection pump and a relief valve for controlling the output pressure of the feed pump so that it varies in accordance with the speed at which the apparatus is driven.

* * * * *